United States Patent [19]

Beck

[11] 4,272,639

[45] Jun. 9, 1981

[54] HELICALLY WOUND HEATER

[75] Inventor: Jacob H. Beck, Waban, Mass.

[73] Assignee: BTU Engineering Corporation, North Billerica, Mass.

[21] Appl. No.: 62,757

[22] Filed: Aug. 1, 1979

[51] Int. Cl.[3] ..... H05B 3/14

[52] U.S. Cl. ..... 13/25; 338/296; 338/316

[58] Field of Search ..... 13/25; 338/296, 322, 338/330, 304, 316, 298

[56] References Cited

U.S. PATENT DOCUMENTS

| | | | |
|---|---|---|---|
| 1,715,018 | 5/1929 | Brockdorff | 338/316 X |
| 3,345,597 | 10/1967 | Schrewelius et al. | 13/25 X |

*Primary Examiner*—Roy N. Envall, Jr.

*Attorney, Agent, or Firm*—Weingarten, Maxham & Schurgin

[57] ABSTRACT

A high temperature electrical resistance heater for use within a high temperature furnace. The heater comprises an elongated tubular element which includes a first axially extending helical section of high resistance and a second axially extending tubular section which is contiguous with and electrically and thermally joined to the helical section and of low resistance. An elongated solid or tubular rod is disposed coaxially within the tubular element and is affixed at one end to the confronting end of the helical section. Fastening elements are provided to maintain the coaxial position of the rod within the tubular element and to maintain the helical section in compression. The coaxial ends of the rod and tubular section include electrical terminals for connection to an external power source. In an alternative embodiment, a second elongated tubular element is coaxially disposed within the first tubular element and includes both a helical section of high resistance and a tubular section of low resistance. The high resistance portions provide a conductive electrical path to the heating section while mimimizing the heating thereof.

19 Claims, 8 Drawing Figures

HELICALLY WOUND HEATER

FIELD OF THE INVENTION

This invention relates to high temperature heating elements for electrical furnaces and more particularly to an electrical resistance helically wound heater.

BACKGROUND OF THE INVENTION

Electrical resistance heaters formed of helically wound resistance wire are widely employed in high temperature furnaces. Such heaters are typically supported by ceramic cores such as grooved plates or cylinders in which the heater is supported and confined throughout its entire length by the ceramic structure. The ceramic core usually has a plurality of longitudinal grooves formed therein and surrounding the coil around a major portion of its periphery. The groove may be filled with refractory sealing material such that the heater is fully embedded in a ceramic core, or a packed ceramic powder can surround the heater coil and be sheathed by a metal tube.

The weight of the ceramic support structure constitutes a major percentage of the overall heater assembly mass by reason of the of ceramic necessary for support of the heater coil and the inherent density of the ceramic material. Such ceramic support structures have relatively low thermal insulation properties and as a result of the relatively massive amount of ceramic material present, a heater of conventional construction exhibits a high thermal inertia which limits the rapidity with which a change of temperature can be accomplished. The response of such conventional heaters to temperature control is thereby limited by the relatively slow thermal response of the heater structure. The high thermal inertia also affects the overall efficiency of a conventional heater since the heat must saturate the surrounding ceramic material before direct radiation to the product from the heater can significantly occur. The ceramic core even in those conventional heaters having an open groove effectively shades all or a major portion of the direct radiation emitted by the heater coil thereby providing a low emissivity, which in turn promotes a substantial differential in temperature between the product and the heating coil, causing inefficiency and shorter heater life.

In heaters of conventional construction supported by a ceramic structure, the length, weight and mode of mounting the heater is dictated to a great extent by the strength of the ceramic support. Self-supporting heaters are known in which ceramic supporting structures are not employed but such conventional self-supporting heaters suffer other deficiencies. A helical silicon carbide heater is shown in U.S. Pat. No. 3,859,501 in which the heating element is in the form of a helical silicon carbide element having a small gap between the helical turns. A voltage differential exists across the gap and can be of sufficient magnitude to cause a voltage discharge especially in the presence of contaminants which condense or otherwise become disposed in the gap. The helical heater construction is also structurally weak.

Another conventional refractory heater known as a Norton SU heater employs two parallel rods of silicon carbide each having a high resistance portion and a low resistance portion. The high resistance portions of the rods are, in operation, disposed within a furnace chamber and are connected at their ends by a connecting block of silicon carbide. The connecting block is of a size and configuration to require a relatively large opening in the furnace wall or roof for insertion of the heater into the chamber. In addition, an insulative two hole plug must be precisely mated to the heater to retain the parallel rods within the mounting opening in the furnace. The parallel rod construction is also subject to the deleterious effects of unequal bending stresses during furnace operations. Moreover, the connecting block is of substantial mass such that if the heater is suspended from the roof of a furnace chamber, the heater can be subject to pendulous movement which can cause bending stresses and cracking of the heater rods.

A coaxial heater construction is shown in U.S. Pat. No. 3,764,718 which is of specific design for use in a vacuum furnace. This heater includes a tubular resistor element and a coaxially disposed inner resistor element connected at one end to the surrounding tube. The inner and outer elements are in a primary embodiment of the same resistive material which is stated to be carbon, silicon carbide, metal or metal alloy, and both inner and outer elements serve as heaters, the inner element radiating heat through the outer element which also radiates heat from its surface. In another version of this heater, the outer element is operated primarily as a conductor and as a radiant element for heat generated by one or more inner resistor elements. The heater is movably mounted above a vacuum chamber and the outer element is adapted to be disposed within the chamber for radiation from its entire surface.

An improved silicon carbide heater is shown in U.S. Pat. No. 4,080,510, assigned to the assignee of this invention, which comprises an elongated tubular high temperature element having first and second tubular sections contiguous with one another, the first section being of a high resistivity silicon carbide and adapted for disposition within a furnace chamber, the second section being of a low resistivity silicon carbide and adapted for disposition external to the furnace chamber. An elongated rod of silicon carbide of low resistivity material is disposed coaxially within the tubular element and is in electrical connection with an end of the first tubular section. The coaxial ends of the second tubular section and of the rod include contact areas for electrical connection to an external power source. The high resistivity tubular section provides efficient heating, while the low resistivity tubular section and coaxial rod provide a conductive electrical path to the heating section while minimizing the heat thereof.

SUMMARY OF THE INVENTION

The heater constructed and operative in accordance with the invention comprises an elongated tubular element which includes a first axially extending helical section of high resistance and adapted for disposition within a furnace chamber, and a second axially extending tubular section which is contiguous with and electrically and thermally joined to the helical section and of low resistance and adapted for disposition external to the furnace chamber. An elongated rod of low resistance is disposed coaxially within the tubular element and is electrically and mechanically connected at one end to the confronting end of the helical section. Means are provided for maintaining the coaxial position of the rod within the tubular element and for maintaining the helical section in compression. Electrical terminals are provided on the end of the tubular section and confronting end of the rod for connection to an external power source. The heater can be fabricated of metallic and non-metallic materials having the requisite relative resistive properties.

The high resistance helical section operates at a substantially higher temperature than the low resistance section and the inner rod. As a result, heat radiation occurs primarily from the high temperature helical section disposed in the furnace chamber to achieve efficient heating. The low resistance tubular section which is disposed external to the furnace chamber and partially within the furnace wall or roof remains at a lower temperature to minimize heat losses. The inner rod is also of low resistance material and operates at a lower temperature to minimize heating of the interior of the coaxial structure.

In an alternative embodiment, a second elongated tubular element is coaxially disposed within the first tubular element and also includes a helical section of high resistance and a tubular section of low resistance. In this embodiment, the elongated rod which is disposed coaxially within the tubular elements is mechanically joined to the confronting ends of the coaxial helical sections but is electrically insulated therefrom. Means are provided for maintaining the coaxial position of the tubular elements and rod and for maintaining the helical sections in compression. Electrical terminals are provided on the ends of the tubular sections for connection to a power source. In a further embodiment, the helical section or sections can be provided with a differential spacing such that when the heater is at an operating temperature the helix will tend to assume a condition of substantially uniform pitch.

DESCRIPTION OF THE DRAWINGS

The invention will be more fully understood from the following detailed description taken in conjunction with the accompanying drawings in which.

DETAILED DESCRIPTION OF THE INVENTION

Figure 1:
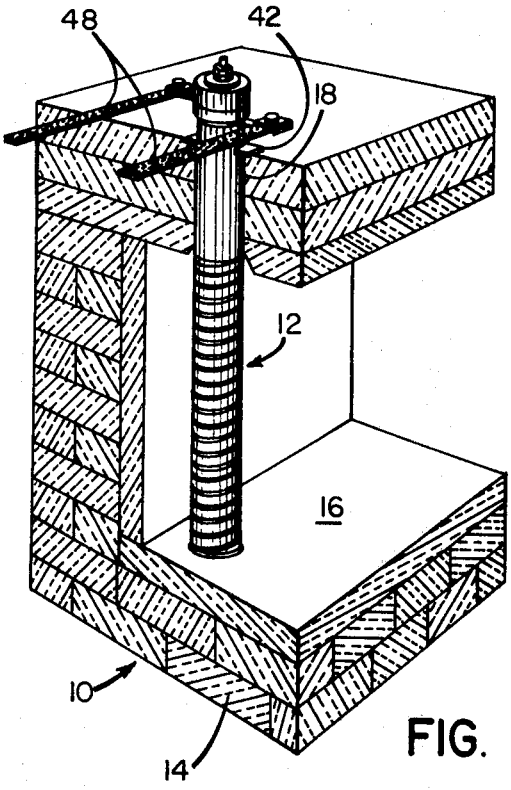
FIG. 1 is a cutaway pictorial view of a furnace showing a heater constructed according the invention.

Referring to FIG. 1, there is shown a furnace 10 incorporating an electrical resistance heater 12 in accordance with the principles of the present invention. Typically the furnace is assembled of appropriate firebrick 14 which encloses a heating chamber 16 in which a product to be processed is disposed. One or more electrical resistance heaters 12 are inserted into the furnace chamber 16 through respective mounting ports 18 in the furnace structure. In the illustrated embodiment a plurality of heaters 12 are spaced along the furnace, each being vertically disposed through a respective port 18 in the roof of the furnace. Each heater extends substantially along the height of the furnace chamber and is disposed near a side wall of the chamber. The heater can also be installed in other positions, such as horizontally through the side wall of the furnace, and the heater mounting which is illustrated is therefore only exemplary.

Figure 3:
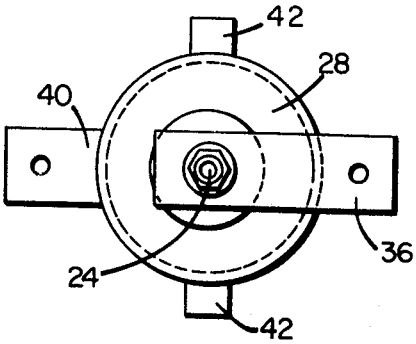
FIG. 3 is a top view of the heater of FIG. 2.
Figure 2:
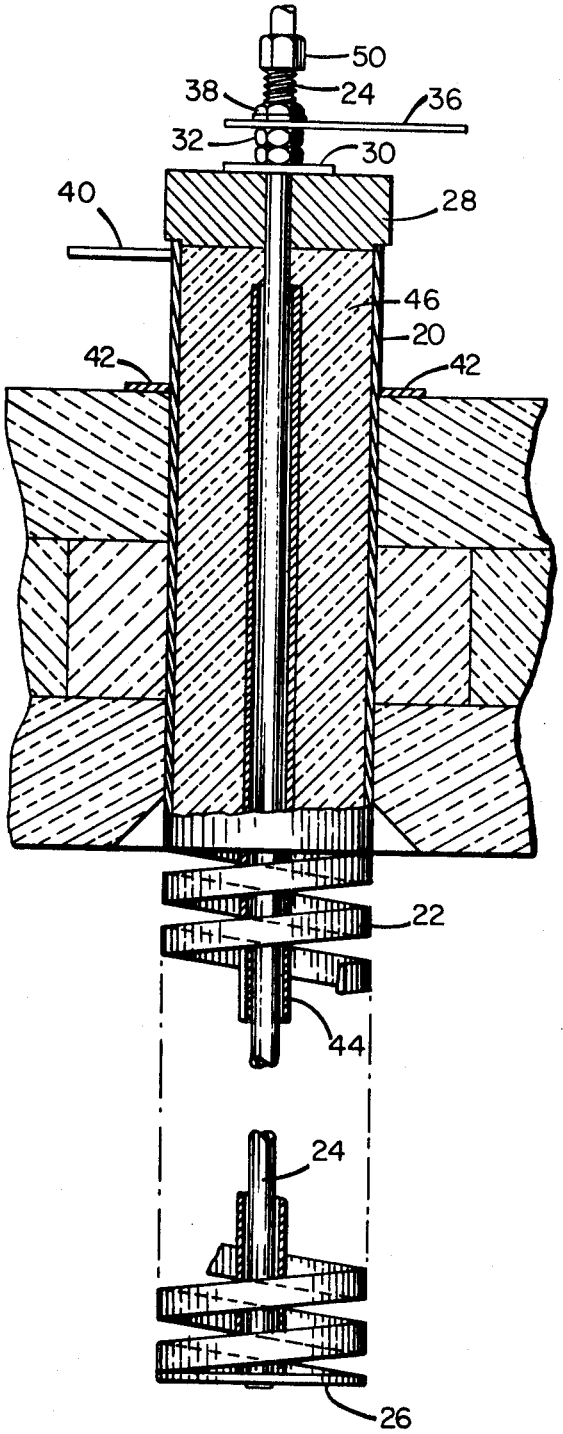
FIG. 2 is a cutaway elevation view of a first embodiment of the novel heater.

The heater 12 is more fully shown in FIGS. 2 and 3 and comprises an axially extending tubular section 20 of relatively low resistance, and joined to a helically wound section 22 of relatively high resistance. An elongated tube 24 of low resistance is disposed coaxially within sections 20 and 22, with one end of tube 24 extending beyond section 20. The other end of tube 24 is electrically and mechanically joined to the confronting end of helical sections 22 by a low resistance element such as a washer 26. The helical section 22, which serves as the high temperature section of the heater, is electrically connected to a power source by the lower temperature section 20 and by the inner tube 24. An electrically insulative collar 28, preferable formed of a alumina or other suitable ceramic, is disposed around the outer end of tube 24 and fitted in the end of section 20 to maintain the coaxial position of tube 24 within sections 20 and 22. A washer 30 preferably of metal is provided around tube 24 and is disposed against the outer surface of collar 28, and one or more nuts 32 are threaded onto the threaded outer end 34 of tube 24 and are tightened by an amount to provide a predetermined compressive force on the heater structure. The tube 24 provides a major structural benefit in that the stress is divided between the tube 24 and the surrounding helical section 22. The degree of stress which is effectively transferred to the tube 24 is determined by the amount of compressive force provided by tightening of nuts 32 on the threaded end of the central tube 24.

An electrical terminal strip 36 is conductively affixed to the outer end of tube 24, such as by a threaded nut 38, while a second terminal strip 40 is welded or otherwise conductively affixed to the outer end of tubular section 20. Outwardly extending strips 42 are welded or otherwise affixed to section 20 at a position to support the heater in the furnace roof and to limit the insertion length of the heater in the furnace chamber. An electrically insulative sleeve 44 is disposed around tube 24 and extends substantially along the full length of sections 20 and 22 and serves to eliminate any possible short circuit between tube 24 and the surrounding helix such as by contaminants entering the helical section 22. A high temperature insulating filler 46 is disposed between tubular section 20 and sleeve 44. Such filler can be a ceramic fiber material.

The heater is installed in a furnace as shown in FIG. 1, with section 20 disposed within the furnace roof and with the helical section 22 disposed in the furnace chamber. Section 20 is of relatively low resistance to provide a conductive electrical path to the heating section 22 while minimizing the heating of section 20, which in operation is disposed external to the furnace chamber and partially within the furnace roof or wall. The terminal strips 36 and 40 are connected such as by braided wire straps 48 to a power source in any well known manner. Radiation occurs primarily from the higher resistance section 22 for efficient heating of the furnace chamber.

The central tube 24 serves to support the helical section 22 and can also serve as a tube for introduction of gas into the furnace chamber from an external source. A gas fitting 50 is affixed to the outer threaded end of tube 24 and is coupled to a gas source for supplying gas through the tube 24 to the interior of the furnace. Alternatively, a central rod of solid cross-section can be employed for structural purposes and without the provision for gas introduction.

Figure 5:
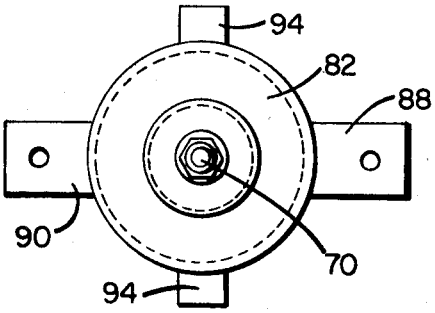
FIG. 5 is a top view of the heater of FIG. 4.
Figure 6:
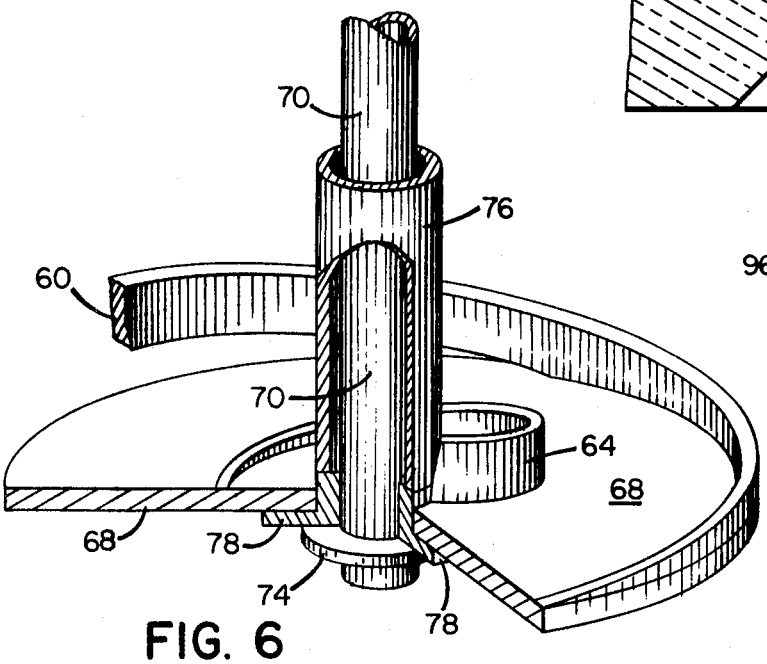
FIG. 6 is a cutaway view of the inner end portions of the heater of FIG. 4.
Figure 4:
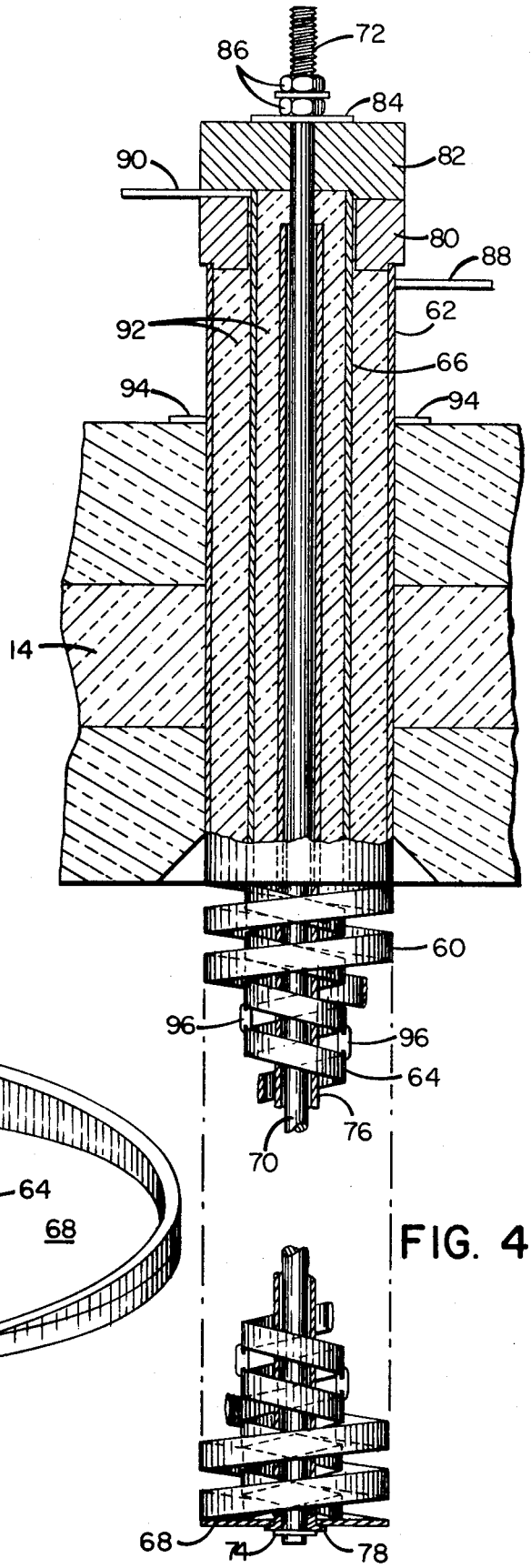
FIG. 4 is a cutaway elevation view of an alternative embodiment of the novel heater.

An alternative embodiment is shown in FIGS. 4–6 which includes both an inner and an outer helical section. An outer helical section 60 of relatively high resistance is electrically and mechanically joined to a tubular section 62 of relatively low resistance, as in the embodiment described above. An inner helical section 64 is provided of relatively high resistance, this section being electrically and mechanically joined to a low resistance tubular section 66 which is of a length to extend beyond the length of tubular section 62. The confronting ends of helical sections 60 and 64 are electrically and mechanically interconnected by means of washer 68 or other suitable element which is welded or otherwise attached to the confronting ends of the coaxial helical structure. A tube 70 is coaxially disposed within sections 64 and 66 and is of a length to outwardly extend from tubular section 66, and terminating at a threaded end 72. The opposite end of tube 70 is affixed to a washer 74 or other retaining element. An electrically insulative sleeve 76 is provided around tube 70 substantially along the length thereof. An electrically insulative spacer 78 extends through an opening in washer 68 and is interposed between the confronting surfaces of washer 68 and washer 74. The tube 70 is thus electrically insulated from the helical sections 60 and 64 by the insulated spacer 78. Other means can be provided to insulate the helical sections from the tube 70. A ceramic or other electrically insulative collar 80 is disposed at the outer end of the heater to maintain the coaxial position of section 66 within section 62. An insulative collar 82 is also provided over collar 80 to maintain the coaaxial position of tube 70 within section 66.

The heater assembly is secured by means of a washer 84 and one or more nuts 86 threaded onto tube end 72. An electrical terminal 88 is welded or otherwise electrically secured to section 62, while a second electrical terminal 90 is similarly secured to section 66. Thermally insulative filler 92 can be provided in the annular space between sections 62 and 66 and between section 66 and sleeve 76. Retaining tabs 94 are provided and outwardly extend from section 62 for mounting of the heater within the mounting opening of the furnace and to define the extent to which the heater extends into the furnace, as in the previously described embodiment.

The helical sections 60 and 64 are compressed to an intended degree by tightening of nuts 86. Ceramic spacers 96 are disposed between the flutes of the inner helical section 64 at spaced intervals to prevent shorting of the inner helix against the outer helix in the event of eccentric dislocation between the concentric helices which might occur under high temperature operation.

The inner helical section 64 increases the overall radiant surfaces of the heater and thus the power density of the heater. The presence of the inner helix also increases the total ohmage of the heater by the amount of the inner helix resistance. As a result, a relatively small group of such heaters can be connected in series across a standard commercial power line without the need for transformers.

In both embodiments described above, the nuts are tightened onto the threaded end of the central rod to control the downward stretch of the helical sections when the heater is at its elevated operating temperature. The amount of stretch can be calculated in advance, or an appropriate adjustment can be made while the heater is operating to prove the intended degree of stretch when hot. The helical sections cannot stretch beyond the predetermined length determined by the tightened length of the central rod. It should be evident that no ceramic elements of the heater structure are subject to tensile forces.

The novel heater structure is self-supporting with a minimum amount of ceramic material. The present heaters employ less than five percent by weight of ceramic insulators thereby providing helical surfaces which emit more useful and unobstructed radiation in comparison to helical heaters of conventional configuration which are wound around a ceramic core.

Figure 7:
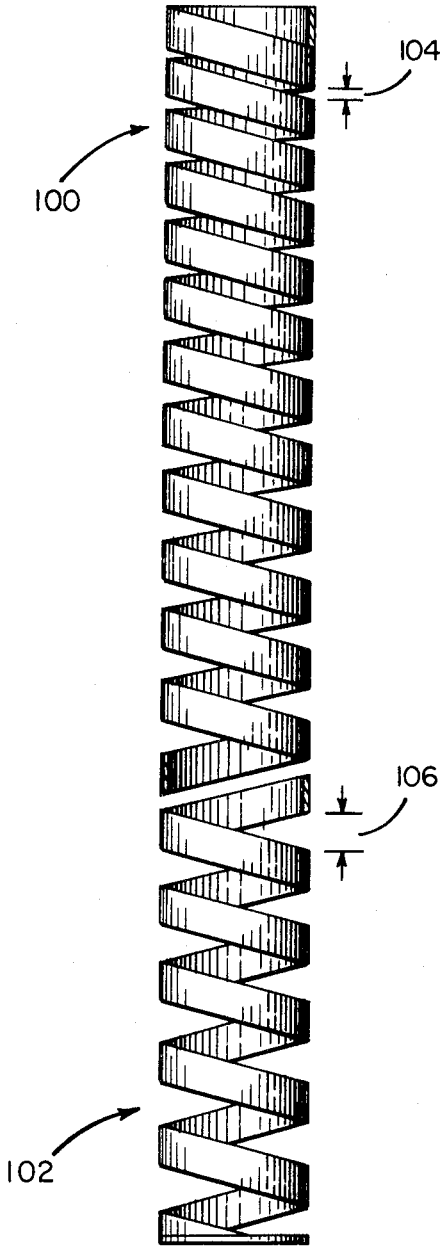
FIG. 7 is an elevation view of a further embodiment of the novel heater employing a variable helical pitch.
Figure 8:
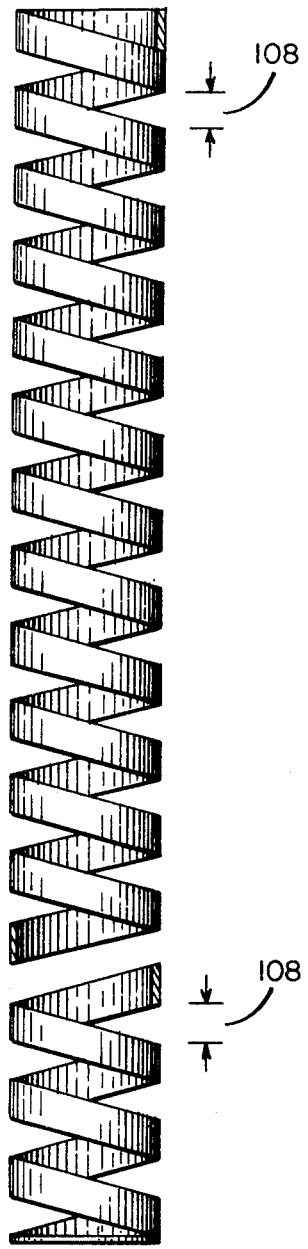
FIG. 8 is an elevation view of the embodiment of FIG. 7 illustrating the helical configuration with the heater an an operating temperature.

A helix freely suspended in vertical position would normally have greater stretch between its upper flutes by reason of the cumulative weight of each helical turn. Heating of the helix will accentuate this differential spacing with likely strain imposed on the helix. The flutes of the helical sections of the novel heater can be provided such that the heater will initially have a differential spacing inverse to that caused by gravitational and heating stretch. Thus, the spacings between the upper helical turns so that after the helix has been stretched due to heating and gravity, it will tend to provide a substantially even spacing and approach a condition of uniform pitch. Thus the helical section is wound with a biased differential pitch which is inverse to that of the normal differential stretch that would occur because of gravity. As a result, the helical section is subject to less strain when heated. A helical section of the novel heater is shown in FIG. 7 in unheated condition. The upper flutes 100 have smaller gaps 104 therebetween than the gaps 106 between the lower flutes 102. When heated, as depicted in FIG. 8, the variable stretch of the flutes will tend to provide a substantially uniform gap 108. The overall stretch of the helical section is limited by the allowable stretch of the central tube or rod securing the entire heater structure.

The novel heater can be constructed of various materials, both metallic and non-metallic, having the requisite resistive and structural properties. Resistive alloys can be employed such as Nicrome, Inconel, Incoloy or Kanthal, or metals can be employed such as platinum, molybdenum or tungsten. Non-metallic materials can be employed such as silicon carbide, carbon or graphite. Since in accordance with the invention the helical section of the heater is maintained in compression and applied stress is divided between the central tube and the coaxial helical section, the helical section is subject to less strain than conventional heater structures, and materials can be employed for the helical sections based upon their high temperature properties even though such materials may have relatively poor mechanical properties. For example, materials having poor creep strength or stress-to-rupture ratios can be employed for the helical section of the heater, while the central tube and surrounding tubular section are fabricated of a material having the requisite structural properties to prevent undue strain on the relatively fragile helical section.

The relatively high and low resistive properties of the helical section, tubular section and inner tube can be achieved by the properties of the materials themselves and the dimensions of the materials employed. For example, one material of high resistivity can be employed for the helical section and another material of low resistivity can be employed for the tubular section and inner tube. Alternatively, a single material can be employed for all constituents of the heater but of different cross-sectional area and length to achieve the intended relatively high and low resistances. A typical metallic heater can employ a Kanthal alloy for the helical sections and for the low resistance tubes, and Inconel for the central tube. A typical non-metallic heater can be of graphite for all elements except the electrical insulation.

If the heater is fabricated of a non-metallic material or if the portions of the heater to which electrical terminal connections are to be made are non-metallic, metallized areas can be provided to serve as contact areas for electrical connection to an external power source. For example, a metallized band can be applied to the outer end of tubular section 20, while a similar metallized band can be provided around the outer end of tube 24. A conductive clamp can be secured to each contact area, the clamps being connected such as by braided wire straps to a power source. Such electrical terminal connection is shown in the aforesaid U.S. Pat. No. 4,080,510.

The invention is not to be limited by what has been particularly shown and described, except as indicated in the appended claims.

What is claimed is:

1. A high temperature electrical resistance heater adapted for use within a high temperature furnace and comprising:

an elongated tubular element including:

a first axially extending helical section of high resistance and adapted for disposition within a furnace chamber, and having helical turns spaced from one another;

a second axially extending tubular section contiguous with and electrically and thermally joined to said first section and of low resistance and adapted for disposition external to the furnace chamber;

an elongated rod of low resistance disposed coaxially within and substantially coextensive with said tubular element;

a member of low resistance electrically and mechanically connecting the end of said first section to the confronting end of said rod;

means for maintaining the coaxial position of said rod within said tubular element;

means for maintaining said helical section in compression; and means for electrically connecting an end of said second section and confronting end of said rod to a power source.

2. A high temperature heater according to claim 1 including an electrically insulative sleeve disposed around said rod and being substantially coextensive with said tubular element.

3. A high temperature heater according to claim 1 wherein said rod is of tubular form having an opening extending completely therethrough; and means on the end of said rod adapted for connection to a gas source to permit the introduction of gas through said tubular rod into a furnace chamber.

4. A high temperature heater according to claim 1 wherein said rod is of solid cross-section.

5. A high temperature heater according to claim 1 wherein said means for electrically connecting includes a first electrical terminal strip conductively affixed to an end of said second section, and a second electrical terminal strip conductively affixed to the confronting end of said rod.

6. A high temperature heater according to claim 1 wherein said member is a washer electrically and mechanically connecting the confronting ends of said first section and said rod.

7. A high temperature heater according to claim 1 wherein said first and second sections, said rod and said member are metals.

8. A high temperature heater according to claim 1 wherein said first and second sections, said rod and said member are non-metallic materials.

9. A high temperature heater according to claim 8 wherein said non-metallic materials are silicon carbide.

10. A high temperature heater according to claim 1 including one or more outwardly extending elements affixed to said second section at a position to support the heater in a furnace roof and to limit the insertion length of the heater in the furnace chamber.

11. A high temperature heater according to claim 1 wherein said coaxial position maintaining means includes an electrically insulative collar disposed around said rod and attached to a confronting end of said second section;

and wherein said rod includes a threaded end confronting said collar, and at least one fastener threaded onto said threaded end and tightened against said collar by an amount to provide a predetermined compressive force on said first section.

12. A high temperature heater according to claim 1 wherein said helical section has in its unheated state a differential spacing inverse to that caused by gravitational and heating stretch such that when heated to an operating temperature the helical section will approach a condition of uniform pitch.

13. A high temperature heater according to claim 1 including a high temperature insulating filler disposed between said tubular section and said rod.

14. A high temperature heater according to claim 1 wherein said helical section is of a length to be substantially coextensive with the dimension of the furnace chamber along which the heater is disposed;

and wherein said tubular section is of a length to extend through the insulative structure of the furnace and to extend outwardly therefrom;

and wherein said elongated rod is of a length to extend outwardly from the end of said tubular section external to the furnace chamber.

15. A high temperature electrical resistance heater adapted for use within a high temperature furnace and comprising:

a first elongated tubular element including:

a first axially extending helical section of high resistance and adapted for disposition within a furnace chamber; and a second axially extending tubular section contiguous with and electrically and thermally joined to the first section and of low resistance and adapted for disposition external to the furnace chamber;

a second elongated tubular element including:

a third axially extending helical section of high resistance and disposed coaxially within and substantially coextensive with the first section; and a fourth axially extending tubular section contiguous with and electrically and thermally joined to the third section and of low resistance and disposed coaxially within and substantially coextensive with the second section;

means for electrically connecting the confronting ends of said first and third sections;

an elongated rod disposed coaxially within and substantially coextensive with said tubular elements;

means for electrically insulating the ends of said rod from the confronting ends of said first and third sections and for mechanically connecting said rod end to the confronting sections of said first and third sections;

means for maintaining the coaxial position of said tubular elements and said rod;

fastening means for maintaining said first and third sections in compression;

and means for electrically connecting the end of said second section and the confronting end of said fourth section to a power source.

16. A high temperature heater according to claim 15 including an electrically insulative sleeve disposed around said rod and being substantially coextensive with said tubular elements.

17. A high temperature heater according to claim 16 including a plurality of electrically insulative spacers disposed between the flutes of said third helical section at spaced intervals therealong.

18. A high temperature heater according to claim 17 wherein said means for electrically insulating the end of said rod includes:

an electrically insulative washer operative to electrically insulate the end of said rod from the confronting ends of said first and third sections while mechanically connecting said rod end to the confronting ends of said first and third sections.

19. A high temperature heater according to claim 15 wherein said helical sections have in their unheated state a differential spacing inverse to that caused by gravitational and heating stretch such that when at an operating temperature the helical sections approach a condition of uniform pitch.

* * * * *

UNITED STATES PATENT AND TRADEMARK OFFICE

CERTIFICATE OF CORRECTION

PATENT NO. : 4,272,639

DATED : June 9, 1981

INVENTOR(S) : Jacob H. Beck

It is certified that error appears in the above—identified patent and that said Letters Patent is hereby corrected as shown below:

Abstract, last line, "mimimizing" should read --minimizing--.

Column 1, line 25, "by reason of the of ceramic" should read --by reason of the ceramic--.

Column 2, line 50, "heat" should read --heating--.

Column 3, line 40, "according the invention;" should read --according to the invention;--;

line 54, "heater an an" should read --heater at an--.

Column 5, line 37, "coaax-" should read --coax---.

Signed and Sealed this

*Twelfth* Day of *January 1982*

[SEAL]

*Attest:*

GERALD J. MOSSINGHOFF

*Attesting Officer*

*Commissioner of Patents and Trademarks*